US005992848A

United States Patent [19]

Krutsch et al.

[11] Patent Number: 5,992,848

[45] Date of Patent: Nov. 30, 1999

[54] VERTICALLY DISPLACEABLE RAMP

[75] Inventors: John Krutsch; Patrick Lawlor, both of Chicago, Ill.

[73] Assignee: Williams Electronics Games, Inc., Chicago, Ill.

[21] Appl. No.: 09/107,585

[22] Filed: Jun. 12, 1998

[51] Int. Cl.[6] ..... A63F 7/30

[52] U.S. Cl. ..... 273/127 R; 273/118 R; 273/121 R; 273/121 A

[58] Field of Search ..... 273/118 R, 118 A, 273/119 R, 119 A, 121 R, 121 A, 127 R, 127 B, 127 C

[56] References Cited

U.S. PATENT DOCUMENTS 4,968,031 11/1990 Kaminkow et al. ..... 273/121 A 5,226,653 7/1993 Bil et al. ..... 273/121 A 5,474,292 12/1995 Anghelo et al. ..... 273/118 R 5,516,103 5/1996 Lawlor et al. ..... 273/127 R

*Primary Examiner*—Raleigh W. Chiu

*Attorney, Agent, or Firm*—Rudnick & Wolfe

[57] ABSTRACT

A pinball machine having a vertically displaceable ramp play feature. The ramp moves between an upper position in which it does not interfere with gameplay, and a lower position in which the lower edge of the ramp rests on the playfield. When the ramp is in the lower position, balls can be directed up the ramp towards a suitable target, such as a raised playfield.

5 Claims, 3 Drawing Sheets

VERTICALLY DISPLACEABLE RAMP

BACKGROUND OF THE INVENTION

The invention relates, generally, to pinball machines, and more particularly to an improved play feature for such games which is designed to foster and maintain player interest therein.

A typical pinball game includes an inclined playfield which supports a rolling ball, a pair of flipper, a vertical backbox containing the game electronics and a variety of play features. The person who plays the game has control of flippers mounted on the playfield which, when activated by the player at the appropriate time, proper the pinball across the table. A typical object of pinball games is for the player to direct pinballs at selected play features or targets to score points. When a ball passes into an out hole, the ball is no longer accessible and another ball has to be propelled onto the playfield. The duration of the game is normally determined by the length of time that a certain predetermined number of balls can be kept in play.

As will be appreciated, the success of a manufacturer's line of pinball games depends on its ability to attract players to its games. To attract players, it is necessary to provide new, exciting and challenging play features that test the player's skill in addition to entertaining the player.

SUMMARY OF THE INVENTION

The present invention provides a ramp provided as a feature for the playfield of a pinball machine which can be moved between a first position and a second position. In the first position, it is raised above the playfield to a height at which it will not interfere with a ball passing underneath it. In the second position, it provides a surface, inclined relative to the playfield, with one edge in close proximity with the playfield, and an opposing edge raised above the playfield, whereby to allow a ball projected onto the first edge to move up the ramp and be launched off the second edge.

BRIEF DESCRIPTION OF THE DRAWINGS

The invention will hereinafter be described with reference to the drawings in which.

DETAILED DESCRIPTION OF A PREFERRED EMBODIMENT

Figure 1:
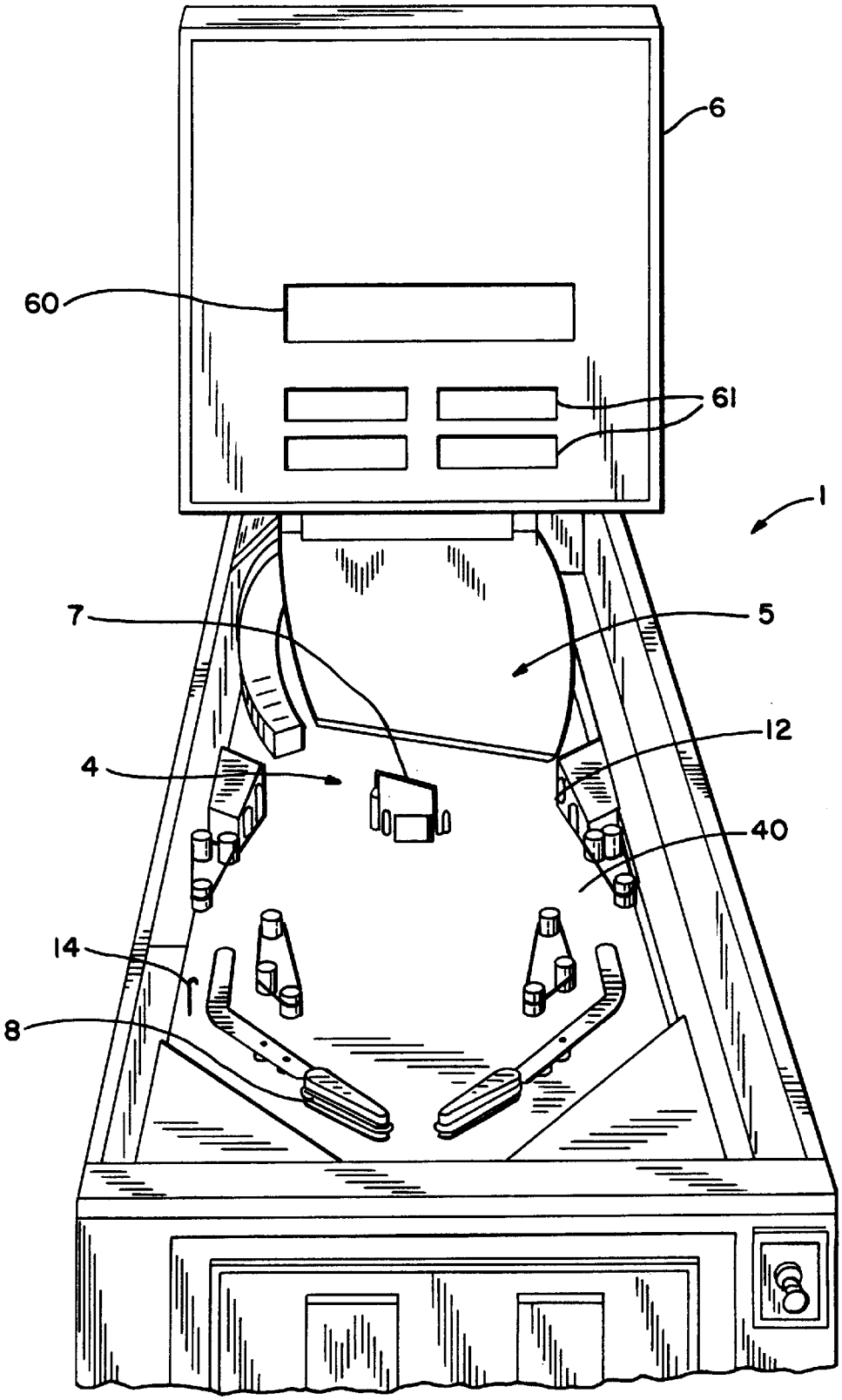
FIG. 1 shows a pinball machines according to a preferred embodiment of the present invention.

A first embodiment of the present invention is shown in FIG. 1. A pinball game 1 is provided with a playfield 4 and backbox 6. The playfield has an upper surface 40 on which a pinball can roll. The playfield 4 is inclined downwardly towards the front of the pinball machine.

The playfield has flippers 8 located close to the front end and operable by the user, as well as components operated on impact by the pinball to propel the pinball in another direction, and targets 12 which respond to impact of a pinball. Sensors 14 are also provided around the pinball table to detect the path of the pinball and activate play and scoring features.

The backbox 6 of the pinball machine has a display 60 which displays information about the progress of the game, under the control of a game microprocessor. Special video based features of the game may be displayed by the display 60.

Scores are displayed in dot matrix panels 61. The backbox 60 contains the majority of the electronics of the pinball machine. In particular, the backbox houses a microprocessor which controls gameplay under the operation of a computer program stored in memory. The microprocessor controls all of the electromechanical features in the playfield.

Figure 3:
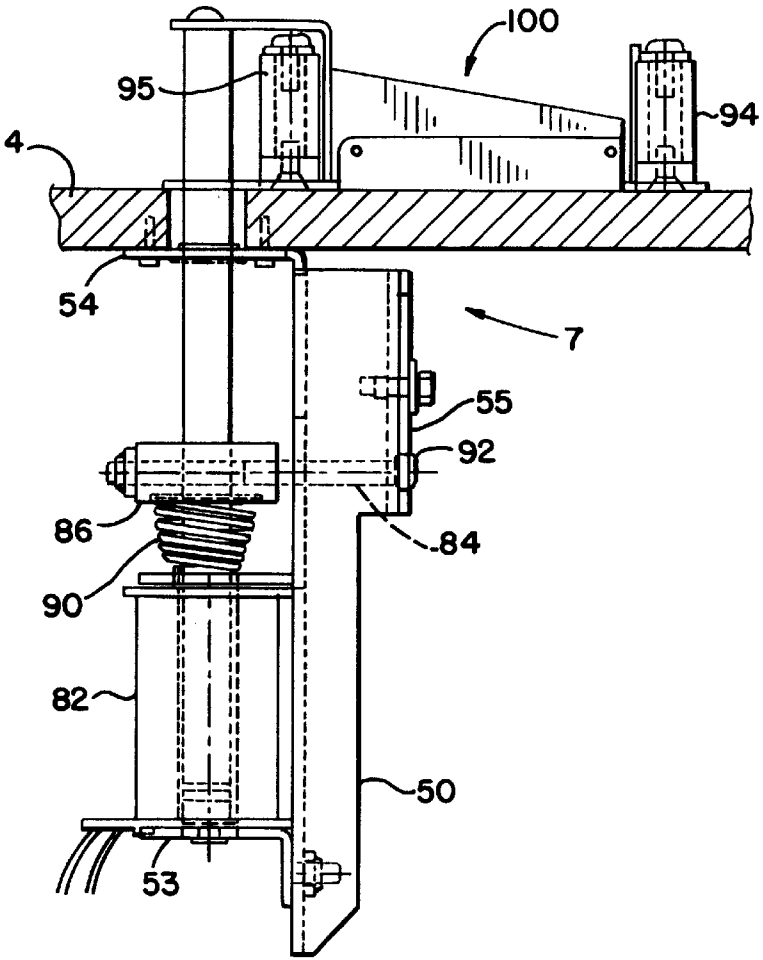
FIG. 3 shows a front view of a ramp assembly provided on the pinball playfield in a lowered position.
Figure 2:
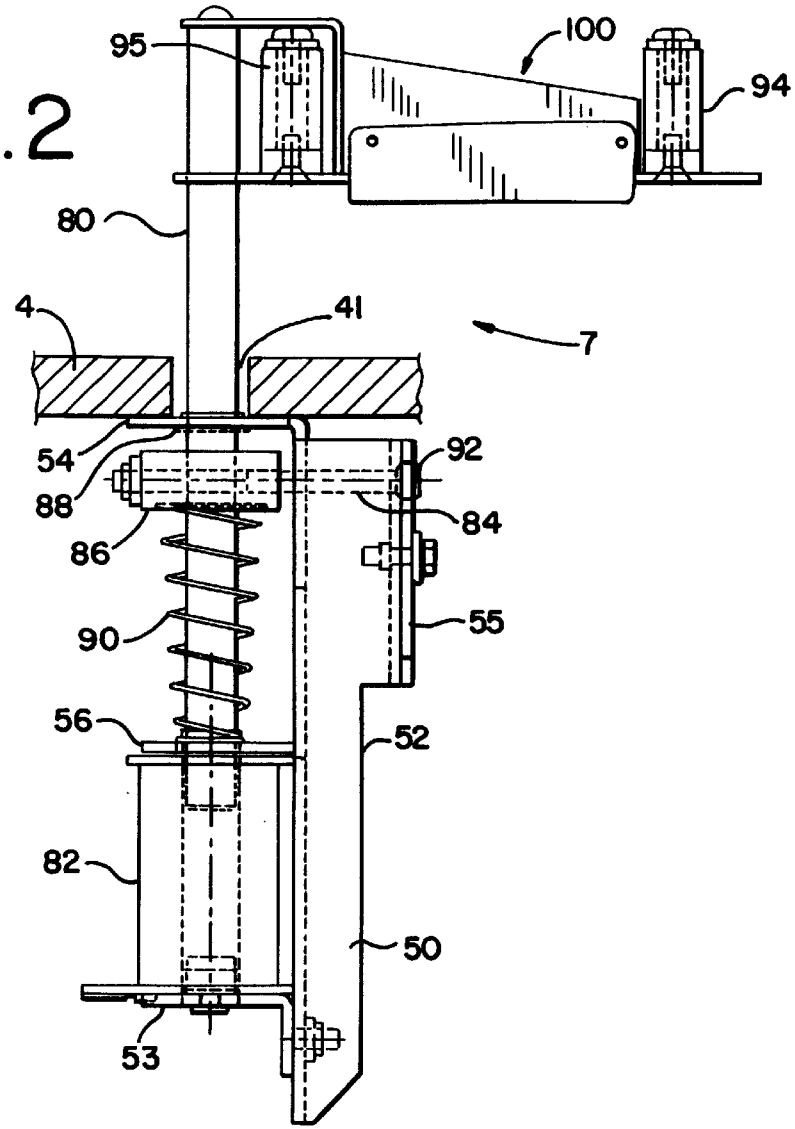
FIG. 2 shows a front view of a ramp assembly provided on a pinball playfield in a raised position.

A ramp assembly 7 according to the presently preferred embodiment of the invention is shown in FIG. 2 in a first, raised position above the playfield. FIG. 3 shows the same ramp assembly in a second, lowered position. The ramp assembly comprises a bracket 50. The bracket is formed from a single sheet of bent material, and comprises an elongated rectangular vertical section 52 with two rectangular sections 54 and 56 extending horizontally at the top of and approximately half way up the member respectively. Horizontal section 54 has four apertures therein for allowing fixing screws to attach the bracket to the underside of the main playfield 4, as shown in FIGS. 2 and 3.

An L-shaped member 53 is attached to the main bracket member 50 by two fixing screws. A solenoid 82 is mounted between a horizontal section of L-shaped member 53 and horizontal section 56 with its axis running vertically.

Horizontally sections 54 and 56 have two larger circular apertures the centers of which are aligned with the axis of the solenoid 82.. A ferromagnetic post member 80 passes through these two apertures, an aperture 41 in the main playfield, and the hollow cylindrical interior of solenoid 82. A nylon bearing 88 is fitted in the aperture on section 54 to slidingly engage post 80. A disc shaped adjusting collar 86 is mounted on the post between the horizontal sections 54 and 56 and held in a raised position by a conical spring 90.

Both the collar 86 and post 80 have horizontal bores therethrough, through which pass a bolt 92. This bolt 92 has a nut at one end to stop the bolt moving along its length. An adjusting plate 55 is attached to the bracket member 50, to allow the adjusting plate to be mounted over a range of horizontal positions, using suitable fixing screws, but not allowing rotation of the adjusting plate. The adjusting plate 55 has a vertical slot therein. This slot is of slightly larger width than the diameter of the circular head of bolt 92. The bolt is of appropriate length to ensure that the widest part of the head is horizontally aligned with the slot. By adjusting the horizontal position of plate 55, the angle at which post 80 is held about its vertical axis can be finely adjusted.

Figure 5:
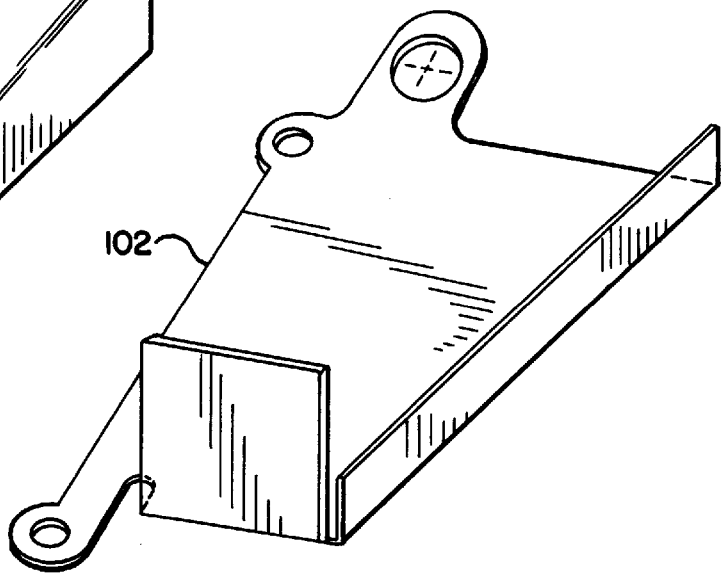
FIG. 5 is a perspective view of an upper part of a ramp according to a preferred embodiment of the present invention.
Figure 6:
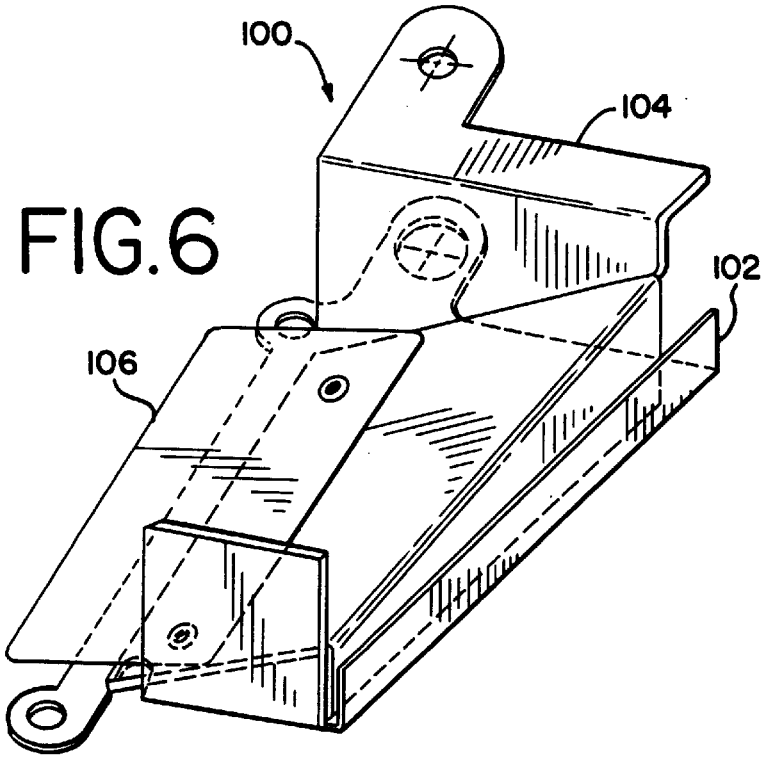
FIG. 6 shows the parts shown in FIGS. 4 and 5 when assembled.

A ramp 100 is welded to the top of post 80. The ramp 100 is formed from an upper part 104 shown in FIG. 5 and a lower part 102. These are secured together to form the ramp assembly 100 shown in FIG. 6. A thin flap 106 is pivotably attached to the ramp. When the lower edge of the ramp is in close proximity with surface of the playfield, the bottom edge of the flap 106 rests on the playfield providing a smooth transition for a ball onto the ramp.

On activation of the solenoid 82, a magnetic force is exerted on ferromagnetic post 80 of greater magnitude than the force exerted by the spring 90. The spring is therefore compressed downward and the bolt, collar and post all move downward until the rod reaches a stop member attached to the L-shaped member 53, as shown in FIG. 3. On deactivation of the solenoid, the post moves up under the action of spring 90 to the upper position shown in FIG. 2. Thus, switching solenoid 82 controls movement of the post between two vertical positions.

The bracket and ramp are constructed in such a way that, when the ramp assembly is in the lower position, the lower edge of the ramp is very close to the upper surface of the playfield, and the flap 106 rests on the playfield as discussed above. When in its upper position, the bottom edge of the flap 106 is sufficiently raised above the playfield to allow a pinball to pass beneath it.

The ramp is oriented toward the flippers as shown in FIG. 1, such that when the ramp assembly is in its lower position a ball may be propelled from the flippers towards the ramp passing onto flap 106 and, by momentum, progress up the ramp and be propelled through the air.

When a game commences, the ramp is normally in its upper position and accordingly does not affect initial gameplay. When certain game objectives are met by hitting various targets, the ramp moves to the lower position. The ramp remains in the lower position for a certain predetermined time, until a certain game objective is achieved, or until a ball is lost from play. The ramp will move into the lower position again at certain points in the game, when further objectives are met. The rules for moving the ramp between its upper and lower positions will vary depending on the specific rules of the pinball game on which it is used.

Figure 4:
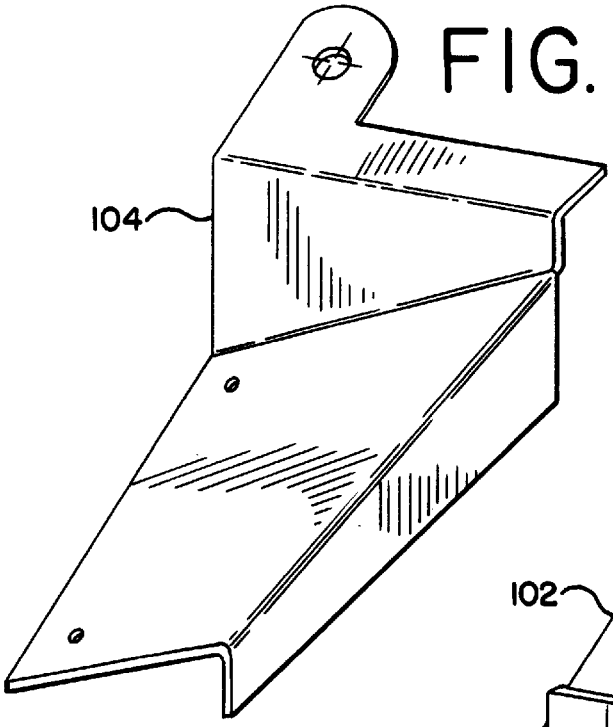
FIG. 4 is a perspective view of a lower part of a ramp according to a preferred embodiment of the present invention.

In one possible arrangement advantageously using the invention, an upper playfield 5 is provided above the lower playfield as shown in FIG. 1, and is inclined at an angle of 14° to the main playfield. In other envisaged embodiments, the upper playfield could lie at other angles relative to the main playfield, and might be parallel to the main playfield. Targets which a pinball can hit are positioned around the upper playfield in the same way as they are positioned around the lower playfield. The upper playfield is spaced away from the top of the ramp in the direction of travel of the ball. When the ramp is in its lower position, as shown in FIG. 4, and the player propels the ball at sufficient speed, the ball can be propelled up the ramp, avoiding the side posts 94, 95, in order to permit the ball to reach the upper playfield. Depending on the speed the ball travels up the ramp, the path the ball follows on the upper playfield will vary, and different targets will be hit, and different points awarded accordingly. This therefore provides a play feature which allows a player to use skill in directing the ball to improve her score.

Modifications of the invention are envisaged wherein the ramp is shaped so that balls hitting the bottom of the ramp at different points along its width follow substantially different trajectories. This could be achieved by giving the ramp a non-planar surface.

Modifications of the invention are envisaged in which the ball is launched from the ramp onto other features such as ramps, each of which can direct the ball to a different location, providing points and activating various features appropriately.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A pinball machine comprising:

a) a playfield on which a pinball may roll;

b) means for player control of the pinball to propel it on said playfield;

c) targets associated with the playfield at which the pinball may be directed to score points or to achieve game objectives;

d) a ramp having a lower end and an upper end;

e) an actuator for moving said ramp between upper and lower positions relative to said playfield, wherein, when said ramp is in said lower position, the lower end of said ramp is positioned to permit a pinball moving in a first direction to move onto the lower end of said ramp, travel up said ramp, and leave said ramp at the upper end thereof; wherein, when said ramp is in said upper position, said lower end of said ramp is spaced from said playfield by a distance greater than the diameter of said pinball; and wherein said actuator is positioned such that said pinball can move underneath said ramp without interference in said first direction when said ramp is in said upper position.

2. A pinball machine according to claim 1 wherein the bottom of the ramp is in contact with said playfield when said ramp is in said lower position.

3. A pinball machine according to claim 1 further comprising a second playfield disposed above the first playfield and arranged such that balls traversing said ramp may reach said second playfield.

4. The pinball machine of claim 1 wherein said actuator includes:

a shaft arranged substantially perpendicular to said playfield to which said ramp is secured for movement therewith relative to said playfield.

5. The machine according to claim 4 wherein said actuator comprises:

a solenoid and a spring in opposed relation whereby the solenoid moves the shaft to one of said raised and lowered position when energized and the spring returns the shaft to the other of said positions when the solenoid is deenergized.

* * * * *